US012110762B2

(12) United States Patent
Ackroyd

(10) Patent No.: US 12,110,762 B2
(45) Date of Patent: Oct. 8, 2024

(54) SUBSURFACE SAFETY VALVE AND METHOD OF OPERATING A SUBSURFACE SAFETY VALVE

(71) Applicant: Expro North Sea Limited, Aberdeen (GB)

(72) Inventor: Warren Ackroyd, Aberdeen (GB)

(73) Assignee: Expro North Sea Limited, Dyce (GB)

( * ) Notice: Subject to any disclaimer, the term of this patent is extended or adjusted under 35 U.S.C. 154(b) by 129 days.

(21) Appl. No.: 17/641,717

(22) PCT Filed: Sep. 9, 2020

(86) PCT No.: PCT/EP2020/075228
§ 371 (c)(1),
(2) Date: Mar. 9, 2022

(87) PCT Pub. No.: WO2021/048225
PCT Pub. Date: Mar. 18, 2021

(65) Prior Publication Data

US 2022/0298887 A1 Sep. 22, 2022

(30) Foreign Application Priority Data

Sep. 9, 2019 (GB) ..... 1912947

(51) Int. Cl.
*E21B 34/06* (2006.01)

(52) U.S. Cl.
CPC ..... *E21B 34/066* (2013.01); *E21B 2200/05* (2020.05)

(58) Field of Classification Search
CPC ..... E21B 34/066; E21B 34/10; E21B 2200/05
See application file for complete search history.

(56) References Cited

U.S. PATENT DOCUMENTS

| | | | | |
|---|---|---|---|---|
| 6,102,828 | A | 8/2000 | MacKenzie | |
| 6,253,843 | B1 | 7/2001 | Rawson | |
| 2009/0229814 | A1* | 9/2009 | Going, III | E21B 34/066 166/66.4 |
| 2016/0177668 | A1* | 6/2016 | Watson | E21B 34/142 166/373 |
| 2017/0002945 | A1 | 1/2017 | Phelps | |

FOREIGN PATENT DOCUMENTS

| | | | |
|---|---|---|---|
| WO | 9522027 | W | 8/1995 |

* cited by examiner

*Primary Examiner* — Robert E Fuller
(74) *Attorney, Agent, or Firm* — Getz Balich LLC

(57) ABSTRACT

A subsurface safety valve that includes an assembly configured to convert rotary motion from an electrically controlled drive into linear motion of a member. The member is configured to actuate a valve and to decompress an elastic member upon loss of a signal to the electrically controlled drive, and to compress the elastic member when the electrically controlled drive receives a signal.

13 Claims, 8 Drawing Sheets

SUBSURFACE SAFETY VALVE AND METHOD OF OPERATING A SUBSURFACE SAFETY VALVE

This application claims priority to PCT Patent Appln. No. PCT/EP2020/075228 filed Sep. 9, 2020, which claims priority GB Patent Appln. No. 1912947.7 filed Sep. 9, 2019, which are herein incorporated by reference.

BACKGROUND OF THE INVENTION

1. Technical Field

Some described examples relate to valves for use in oil and gas applications, and in particular subsurface safety valves and methods of operating a subsurface safety valve.

2. Background Information

It is generally universal practice that all well structures should include a subsurface safety valve. Subsurface safety valves may be used in offshore as well as onshore well structures.

Subsurface safety valves are provided in oil and gas wells to shut off the flow of product from the formation towards the surface in situations where continuing flow of product could be dangerous. Subsurface safety valves are fail safe so that the wellbore structure is isolated in the event of any failure or damage. When closed, subsurface safety valves isolate wellbore fluids from the surface. When open, subsurface safety valves allow flow of fluids between the wellbore and the surface.

Two types of subsurface safety valves are generally available: surface-controlled and subsurface controlled. Surface-controlled safety valves may operate on the basis of applied hydraulic pressure. Hydraulic pressure is supplied via a control line conduit, typically appended to the outside of wellbore production tubing, allowing hydraulic communication from the surface to the subsurface safety valve.

When hydraulic pressure is applied, an internal differential piston (singular or multiple) creates sufficient force to overcome an internally mounted compression spring. As the applied hydraulic pressure increases further, the force transfers linear motion to a flow tube which in turn pushes open a flapper of a flapper valve.

As long as applied hydraulic pressure is maintained above a predetermined minimum operating pressure, the flapper valve will remain in the open position. When applied hydraulic pressure falls below the minimum operating pressure, the potential energy stored within the compression spring is insufficient to maintain the flapper in the open position and the flow tube retracts back to its original position.

While subsurface safety valves are known, alternatives and or improvements are desired.

This background serves only to set a scene to allow a skilled reader to better appreciate the following description. Therefore, none of the above discussion should necessarily be taken as an acknowledgement that that discussion is part of the state of the art or is common general knowledge. One or more aspects/embodiments of the invention may or may not address one or more of the background issues.

SUMMARY OF THE INVENTION

In some examples, there are provided subsurface safety valves and methods of operating a subsurface safety valve that do not rely on the application of hydraulic pressure. Subsurface safety valves and methods of operating a subsurface safety valve are electrically driven. As such, such valves and methods provide alternatives to hydraulic pressure actuated subsurface safety valves. Such hydraulic pressure actuation may be inappropriate, more costly and/or more prone to failure. As such, the subject subsurface safety valves and methods of operating a subsurface safety valve may provide cheaper, more efficient and/or more robust alternatives to known valves and methods.

In one example, a subsurface safety valve is provided that is cost-saving, robust and/or efficient. The subsurface safety valve may result in reduced wear of components and/or a longer lasting valve.

In some examples, the subsurface safety valve comprises an assembly configured to convert rotary motion from an electrically controlled drive into linear motion of a member, the member configured to actuate a valve.

Electric control of the drive ensures that if the electrically controlled drive loses electric power or fails to receive a signal, the member does not actuate the valve. Without actuation of the valve, the valve does not open. This ensures that wellbore fluid is isolated until a signal is provided to the electrically controlled drive.

In some examples, the member is further configured to close the valve upon loss of signal to the valve. Thus, if the signal to the electrically controlled drive is ever interrupted either on purpose due to some detected fault or inadvertently due to a disruption of the line between the electrically controlled drive and surface control, for example, the member closes the valve. The wellbore is isolated thereby preventing accidental release of wellbore fluids which could result in lost profits and/or harm to the environment.

In some examples, the member is further configured to open the valve when the drive receives a signal.

In some examples, the member is further configured to compress an elastic member. In some examples, the member is configured to compress the elastic member when the drive receives a signal.

In some examples, the member is configured to decompress the elastic member upon loss of a signal to the drive.

In some examples, the member is configured to compress the elastic member when the drive receives a signal.

In some examples, the elastic member is ratcheted.

In some examples, the ratcheted elastic member is configured to maintain a compressed state after linear motion of the member stops. The elastic member maintains stored potential energy which applies greater force to the member to actuate the valve.

In some examples, the assembly comprises a retention mechanism. The retention mechanism is configured to retain the spring and/or the shaft in their positions.

In some examples, the retention mechanism comprises a ratchet configured to maintain the elastic member in a compressed state after linear motion of the member stops. In some examples, the ratchet is controlled via a solenoid.

In some examples, upon loss of signal to the solenoid, the spring is no longer latched. In some examples, the signal is an electrical signal. The loss of the electric signal to the solenoid results in the loss of the latching of the elastic member as the ratchet is no longer maintaining the elastic member in a compressed state. Thus, when the elastic member is a spring, the spring releases stored potential energy and returns to an uncompressed state. Therefore, when the solenoid loses electrical power, for example, the spring, for example, will return to an uncompressed state. Furthermore, the member will immediately close the valve.

This ensures that the wellbore fluids are quickly and safety contained and prevents release of wellbore fluids when electrical power to the solenoid is lost.

In some examples, the elastic member is a spring.

In some examples, the assembly comprises a gear assembly.

In some examples, the gear assembly comprises a worm drive. In some examples, the worm drive comprises a worm screw configured to be rotated by the drive. In some examples, the worm drive comprises a worm gear associated with the worm screw. The worm gear is configured to be rotated by the worm screw.

In some examples, the gear assembly further comprises a one-way clutch configured to allow drive and torque in one rotary direction and to freewheel in the other opposition rotary direction. The clutch only applies torque when the member is moving to open the valve. The clutch allows for freewheeling when the member is moving to close the valve.

In some examples, the one-way clutch comprises a sprag clutch. In some examples, the sprag clutch is within a spur gear.

In some examples, linear motion of the member actuates a relief valve. In some examples, the relief valve comprises a ball valve. The ball valve is configured to release pressure that may have built up in the subsurface safety valve.

In some examples, linear motion of the member causes linear motion of a flow tube.

In some examples, the flow tube is configured to actuate a flapper of the valve.

In some examples, an end of the flow tube is profiled such that the end is configured to contact the flapper at a point furthest from a hinge axis of the flapper. This reduces the amount of force and torque required to open the flapper. This provides for quicker and/or more efficient opening of the flapper. Furthermore, wear on parts is reduced resulting in a long lasting subsurface safety valve.

In some examples, the drive is an electric motor.

In some examples, the member comprises an elongate member. In some examples, the elongate member comprises a rack. The rack may form part of a rack and pinion combination.

In another example, a method of operating a subsurface safety valve is provided. The method is cost-saving, robust and/or efficient. The method may result in reduced wear of components and/or a longer lasting valve.

In one example, the method comprises converting rotary motion from an electrically controlled drive into linear motion of a member to actuate a valve.

In some examples, the method further comprises closing the valve upon loss of a signal to the drive. Thus, when the drive loses a signal, the valve is closed preventing unwanted escape of wellbore fluids. This ensures equipment is not damaged and the environment is not harmed. The wellbore is isolated.

In some examples, the method further comprises opening the valve when the drive receives a signal.

In some examples, the method further comprises compressing an elastic member with the member. As the elastic member is compressed, it stores potential energy therein. The stored potential energy is applied to the member, and it ensures faster and more efficient actuation of the valve.

In some examples, the method further comprises decompressing the elastic member upon loss of a signal to the drive. If the drive does not receive power, for example, the elastic member releases stored compressed energy and decompresses. Furthermore, the member closes the valve. Thus, if the drive does not receive power, either by command of the surface control, or due to some detected or other failure of the wellbore, the elastic member decompresses and the member closes the valve thereby isolating the wellbore fluid preventing damage and/or harm.

In some examples, the method further comprises ratcheting the elastic member such that the elastic member is configured to maintain a compressed state after linear motion stops. The elastic member thereby stores potential energy even after linear motion stops.

In some examples, the method further comprises releasing the ratcheted elastic member upon loss of a signal to the drive. The elastic member may be a spring. The loss of the electric signal to the ratchet results in the loss of ratcheting of the spring. Thus, the spring releases stored potential energy and returns to an uncompressed state. Therefore, when the ratchet loses electrical power, for example, the spring will return to an uncompressed state. Furthermore, the member will immediately close the valve as it is associated with the spring. This ensures that the wellbore is quickly and safely isolated to prevent release of wellbore fluids when electrical power to the ratchet is lost.

In some examples, the method further comprises actuating the valve via a flow tube. In some examples, actuating the valve via the flow tube comprises contacting a flapper of the valve at a point furthest from a hinge axis of the flapper. This reduces the amount of force and torque required to open the flapper. This provides for quicker and/or more efficient opening of the flapper. Furthermore, wear on parts is reduced resulting in a long lasting subsurface safety valve.

Aspects of the inventions described may include one or more examples, embodiments or features in isolation or in various combinations whether or not specifically stated (including claimed) in that combination or in isolation.

BRIEF DESCRIPTION OF THE DRAWINGS

A description is now given, by way of example only, with reference to the accompanying drawings, in which.

DETAILED DESCRIPTION OF THE INVENTION

Figure 1:
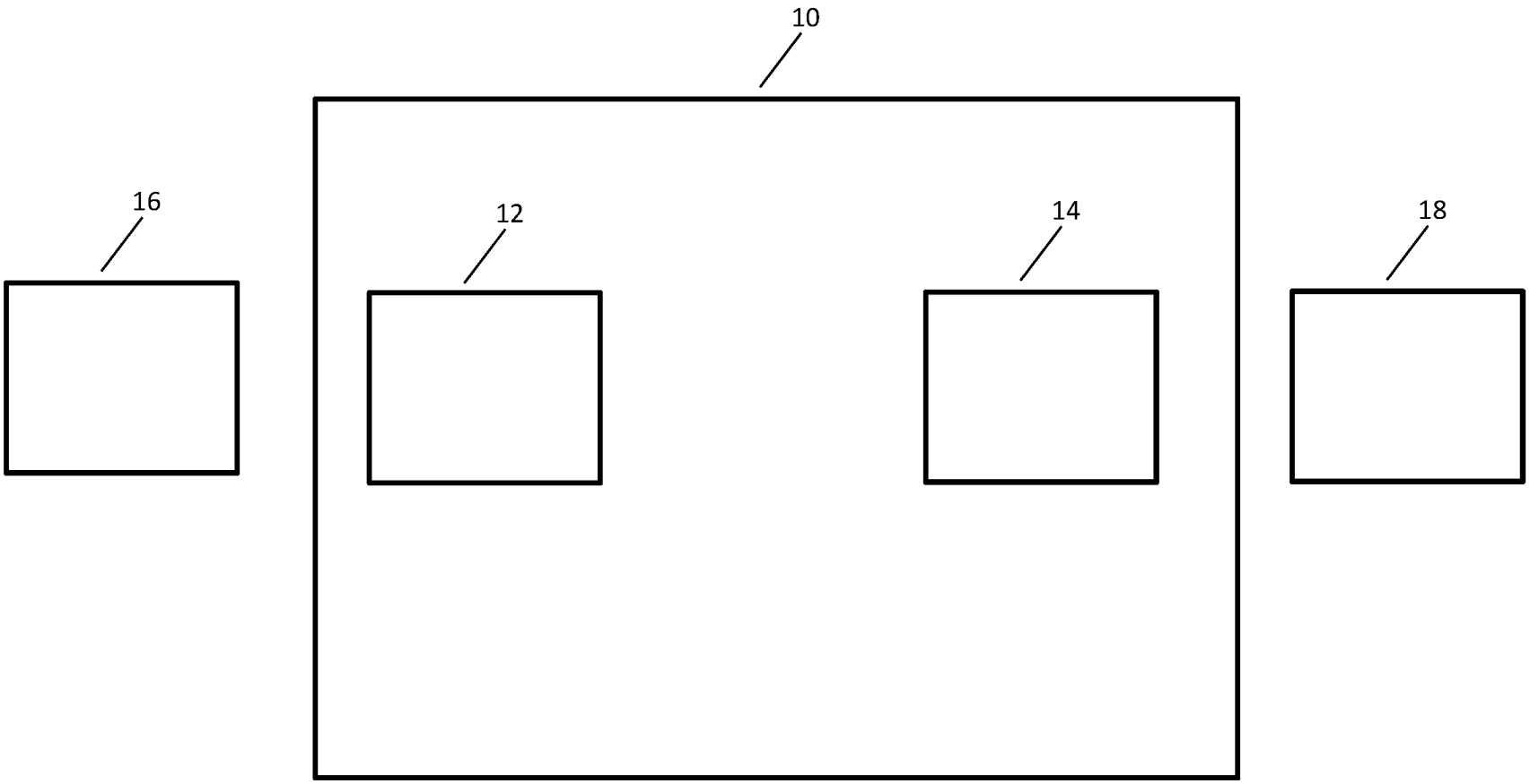
FIG. 1 is a block diagram of a subsurface safety valve in accordance with an aspect of the disclosure.

The foregoing summary, as well as the following detailed description of certain embodiments will be better understood when read in conjunction with the accompanying drawings. As will be appreciated, like reference characters are used to refer to like elements throughout the description and drawings. As used herein, an element or feature recited in the singular and preceded by the word "a" or "an" should be understood as not necessarily excluding a plural of the elements or features. Further, references to "one example" or "one embodiment" are not intended to be interpreted as excluding the existence of additional examples or embodiments that also incorporate the recited elements or features of that one example or one embodiment. Moreover, unless explicitly stated to the contrary, examples or embodiments "comprising", "having" or "including" an element or feature or a plurality of elements or features having a particular property might further include additional elements or features not having that particular property. Also, it will be appreciated that the terms "comprises", "has" and "includes" mean "including but not limited to" and the terms "comprising", "having" and "including" have equivalent meanings.

As used herein, the term "and/or" can include any and all combinations of one or more of the associated listed elements or features.

It will be understood that when an element or feature is referred to as being "on", "attached" to, "connected" to, "coupled" with, "contacting", etc. another element or feature, that element or feature can be directly on, attached to, connected to, coupled with or contacting the other element or feature or intervening elements may also be present. In contrast, when an element or feature is referred to as being, for example, "directly on", "directly attached" to, "directly connected" to, "directly coupled" with or "directly contacting" another element of feature, there are no intervening elements or features present.

It will be understood that spatially relative terms, such as "under", "below", "lower", "over", "above", "upper", "front", "back" and the like, may be used herein for ease of describing the relationship of an element or feature to another element or feature as depicted in the figures. The spatially relative terms can however, encompass different orientations in use or operation in addition to the orientation depicted in the figures.

Reference herein to "example" means that one or more feature, structure, element, component, characteristic and/or operational step described in connection with the example is included in at least one embodiment and or implementation of the subject matter according to the present disclosure. Thus, the phrases "an example," "another example," and similar language throughout the present disclosure may, but do not necessarily, refer to the same example. Further, the subject matter characterizing any one example may, but does not necessarily, include the subject matter characterizing any other example.

Reference herein to "configured" denotes an actual state of configuration that fundamentally ties the element or feature to the physical characteristics of the element or feature preceding the phrase "configured to".

Unless otherwise indicated, the terms "first," "second," etc. are used herein merely as labels, and are not intended to impose ordinal, positional, or hierarchical requirements on the items to which these terms refer. Moreover, reference to a "second" item does not require or preclude the existence of lower-numbered item (e.g., a "first" item) and/or a higher-numbered item (e.g., a "third" item).

As used herein, the terms "approximately" and "about" represent an amount close to the stated amount that still performs the desired function or achieves the desired result. For example, the terms "approximately" and "about" may refer to an amount that is within less than 10% of, within less than 5% of, within less than 1% of, within less than 0.1% of, or within less than 0.01% of the stated amount.

Some of the following examples have been described specifically in relation to well infrastructure relating to oil and gas production, or the like, but of course the systems and methods may be used with other well structures. Similarly, while in the following example an offshore well structure is described, nevertheless the same systems and methods may be used onshore, as will be appreciated.

Turning now to FIG. 1, a block diagram of the subsurface safety valve in accordance with the subject disclosure is shown and generally identified by reference numeral 10. The subsurface safety valve 10 comprises an assembly and a member. The subsurface safety valve 10 is configured to control the actuation, specifically, the opening and closing, of a valve 18. The subsurface safety valve 10 is electrically controlled, as opposed to operating on the basis of applied hydraulic pressure. The dependency on applied hydraulic pressure to actuate the valve 18 is not present.

The configuration of the assembly and member provides a subsurface safety valve 10 that is cheaper, more efficient and more robust that previously described subsurface safety valves, especially subsurface safety valves that operate on the basis of applied hydraulic pressure.

The assembly is configured to convert rotary motion from an electrically controlled drive 16 into linear motion of the member. In this embodiment, the assembly comprises a gear assembly 12. Furthermore, in this embodiment, the member comprises an elongate member 14.

The electrically controlled drive 16 may form part of the subsurface safety valve 10. In this embodiment, the electrically controlled drive 16 is an electric motor.

The elongate member 14 is configured to actuate a valve 18. The valve 18 may form part of the subsurface safety valve 10. In this embodiment, the valve 18 comprises a flapper valve that comprises a flapper. When the flapper valve is closed, the flapper is configured to isolate wellbore fluids. When the flapper valve is open, the flapper is configured to allow for the flow of wellbore fluids.

Figure 2:
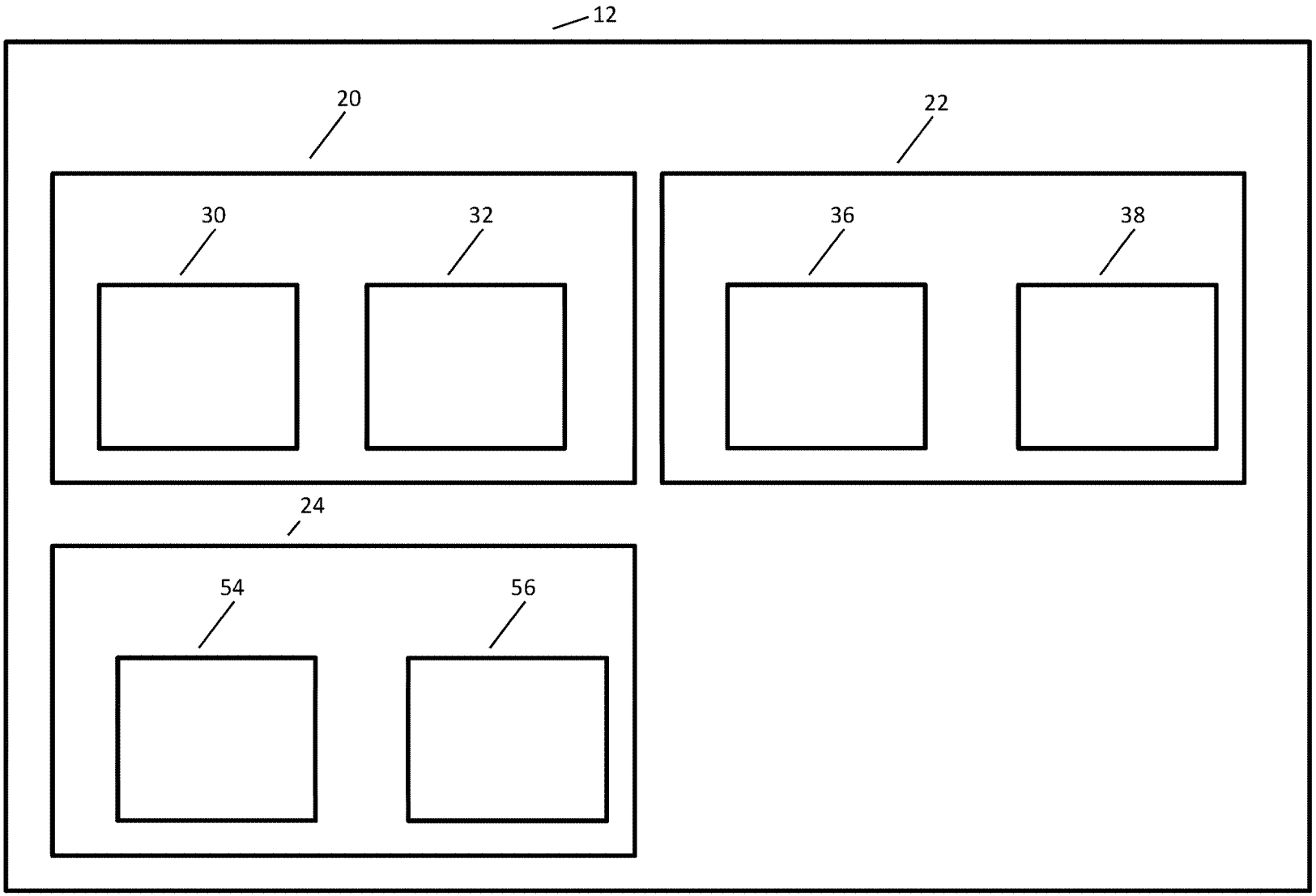
FIG. 2 is a block diagram of the gear assembly of the subsurface safety valve of FIG. 1.

Turning now to FIG. 2, a block diagram of the gear assembly 12 is shown. The gear assembly 12 comprises a worm drive 20, a one-way clutch 22 and a retention mechanism 24.

The worm drive 20 is configured to transfer motion in 90 degrees. The worm drive 20 comprises a worm screw 30 and a worm gear 32. The worm screw 30 is configured to be rotated by the electrically controlled drive 16. In this embodiment, the worm screw 30 is an elongate shaft. The elongate shaft comprises a threaded portion 31.

The worm gear 32 is a gear that is configured to be rotated by the worm screw 30. The worm gear 32 meshes with the threaded portion 31 of the worm screw 30 such that rotation of the worm screw 30 imparts rotation on the worm gear 32. Specifically, teeth of the worm gear 32 mesh with the threaded portion 31 of the worm screw 30.

The one-way clutch 22 is configured to allow drive and torque in one rotary direction and to freewheel in the other opposition rotary direction. The clutch 22 only applies torque when the elongate member 14 is moving to open the valve 18 as will be described. The clutch 22 allows for freewheeling when the elongate member 14 is moving to close the valve 18 as will be described.

The one-way clutch 22 is a free-wheel clutch that, as previously described, allows drive and torque in one rotary direction and freewheels in the other opposition rotary direction. The one-way clutch 22 comprises a sprag clutch 36 and a spur gear 38.

The spur gear 38 is connected to the same axis as the worm gear 32. The spur gear 38 comprises a cylinder or disk with teeth projecting radially from the cylinder or disk. The spur gear 38 is configured to transfer the rotatory motion of the worm gear 32 to the elongate member 14 as will be described.

The sprag clutch 36 is situated within the spur gear 38. The sprag clutch 36 is a one-way freewheel clutch. The sprag clutch 36 allows for rotational drive and torque in one rotary direction and freewheeling in the other opposite rotary direction.

The retention mechanism 24 is configured to retain the elongate member 14 in its position. Specifically, the retention mechanism 24 is configured to retain the elongate member 14 in its linear position. In this embodiment, the retention mechanism 24 is further configured to retain an elastic member in its position as will be described.

The retention mechanism 24 comprises a ratchet and a solenoid 56. The ratchet is configured to maintain the elastic member in a compressed state after linear motion of the elongate member 14 has stopped. In this embodiment, the ratchet is a ratchet wheel 54.

The ratchet wheel 54 is controlled via the solenoid 56. The solenoid 56 is configured such that, upon loss of electric signal to the solenoid 56, the ratchet wheel 54 no longer maintains the elastic member in a compressed state. In other words, upon loss of electric signal to the solenoid 56, the elastic member is no longer latched.

Figure 3:
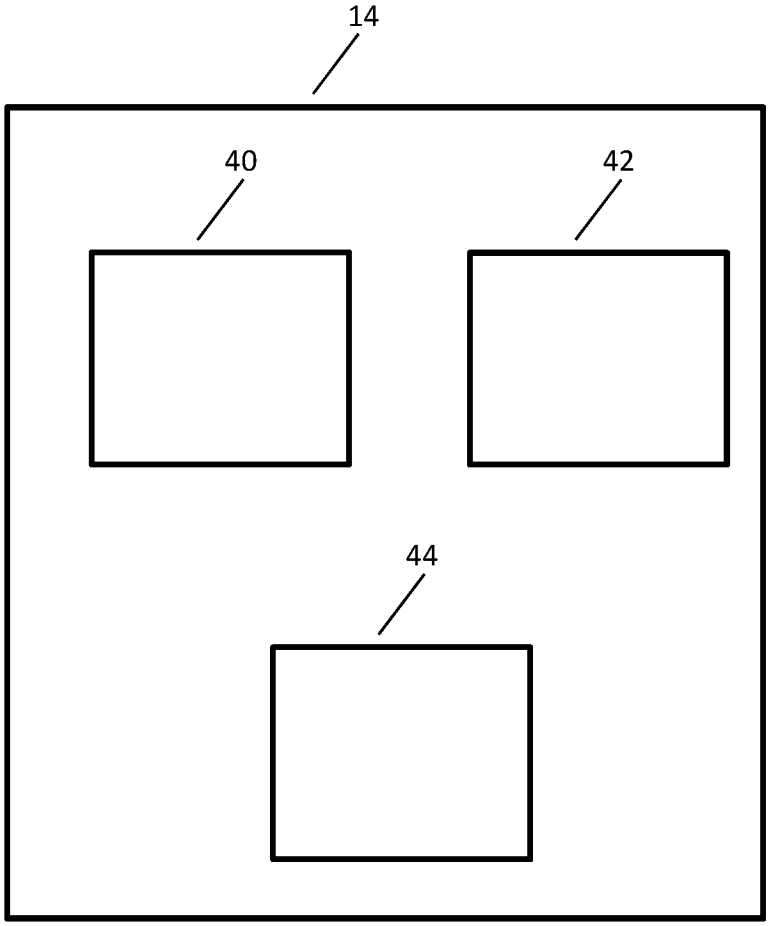
FIG. 3 is a block diagram of the elongate member of the subsurface safety valve of FIG. 1.

Turning now to FIG. 3, a block diagram of the elongate member 14 is shown. The elongate member 14 comprises a shaft 40 and a toothed portion 42. The shaft 40 and toothed portion 42 may from form a rack which forms part of a rack and pinion combination.

The previously described spur gear 38 forms the pinion of the rack and pinion combination. The toothed portion 42 interacts with the teeth of the spur gear 38. The spur gear 38 is configured to impart linear motion on the elongate member 14 via the teeth of the spur gear 38 and the toothed portion 42 of the elongate member 14.

In this embodiment, the elongate member 14 further comprises a flow tube 44. The flow tube 44 is connected to the shaft 40. The flow tube 44 is configured to transfer linear motion of the shaft 40 to the valve 18. The flow tube 44 is configured to actuate a flapper of the valve 18 as will be described. In this embodiment, the flow tube 44 is a hollow, elongate shaft. When the valve 18 is open, wellbore fluids are free to flow through the flow tube 44. When the valve 18 is closed, wellbore fluids are contained beyond the valve 18. Wellbore fluid are prevented from flowing through the flow tube 44 as fluid is contained beyond the valve 18.

In this embodiment, one end of the flow tube 44 is profiled such that this end of the flow tube contacts the flapper of the valve 18 at a point furthest from the hinge axis of the flapper as will be described.

Figure 4A:
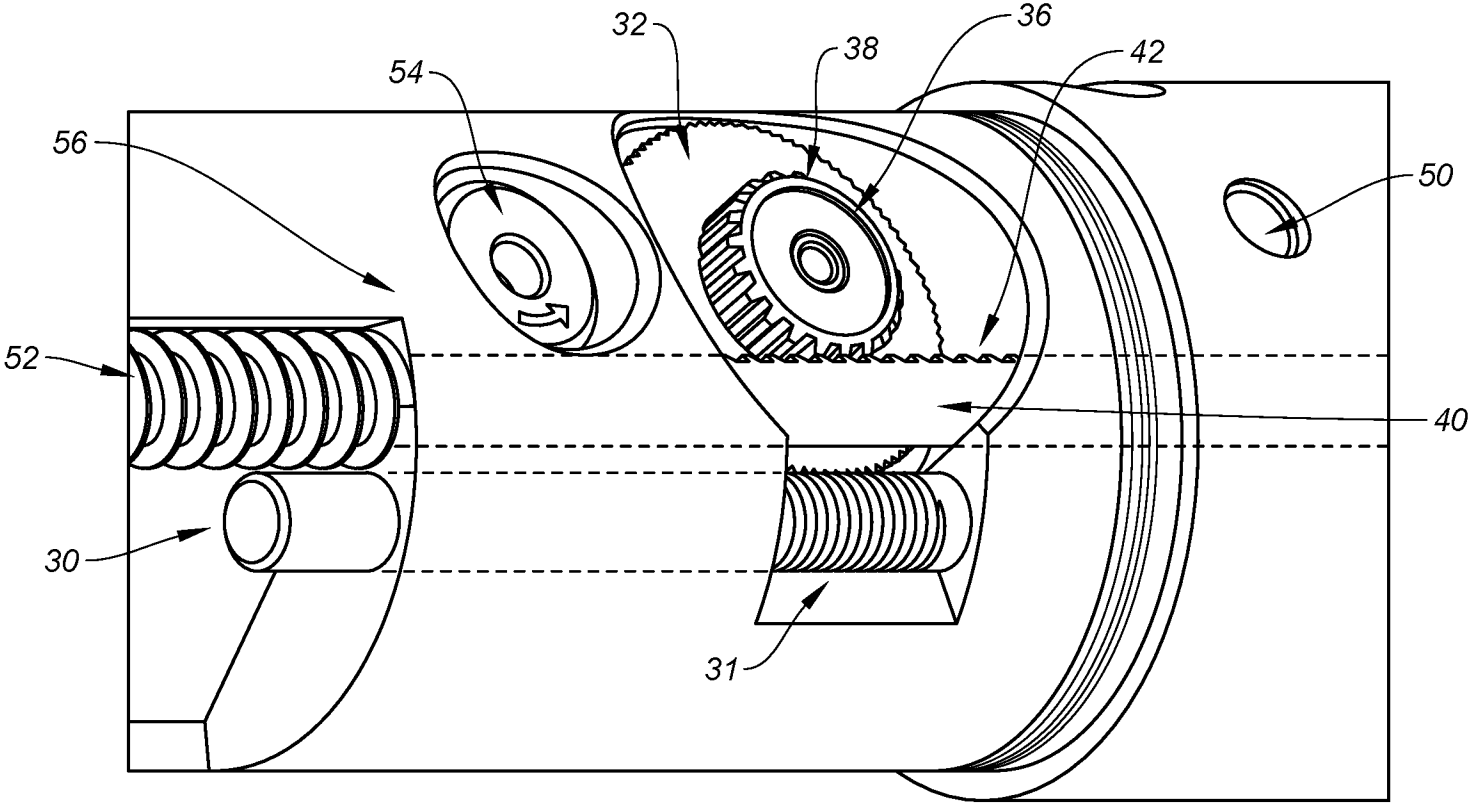
FIG. 4A is a perspective view of a portion of the subsurface safety valve of FIG. 1.
Figure 4B:
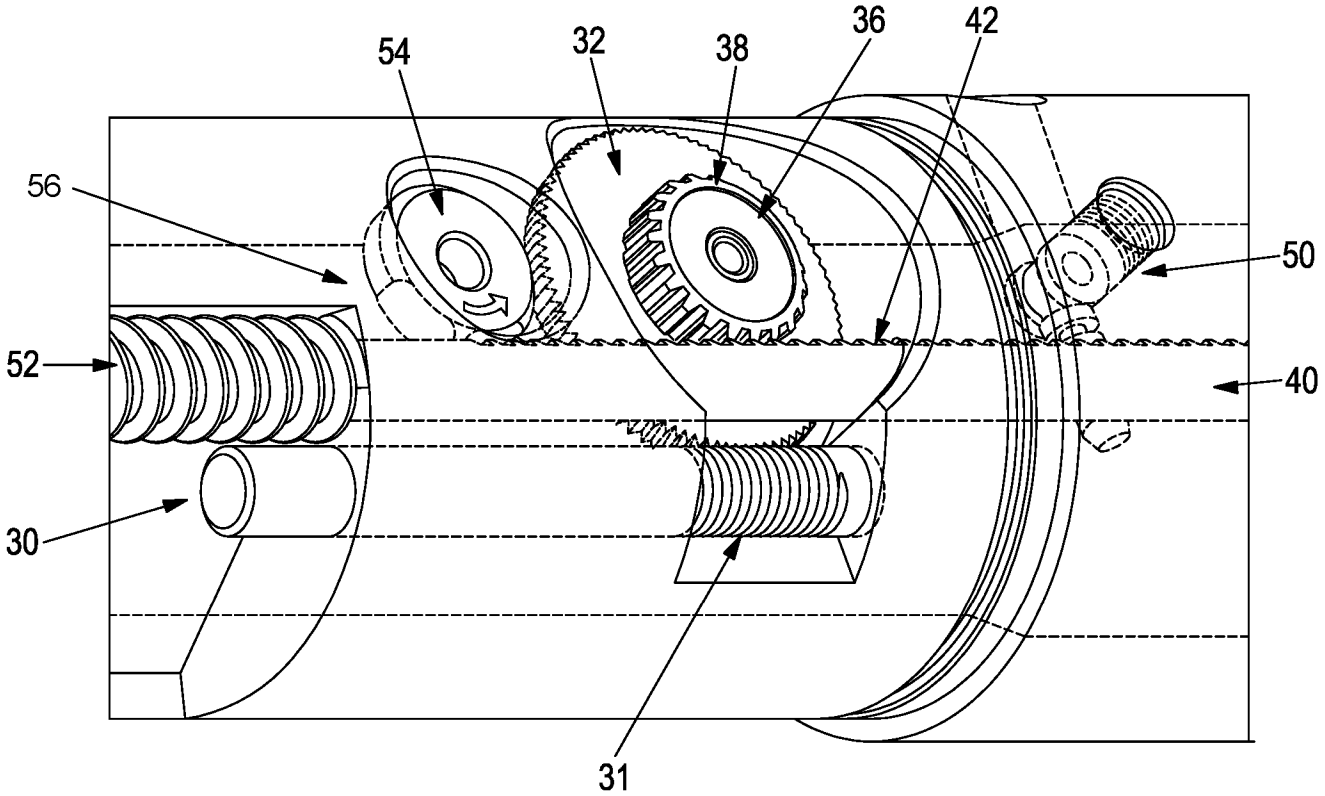
FIG. 4B is a perspective transparent view of a portion of the subsurface safety valve of FIG. 1.
Figure 5:
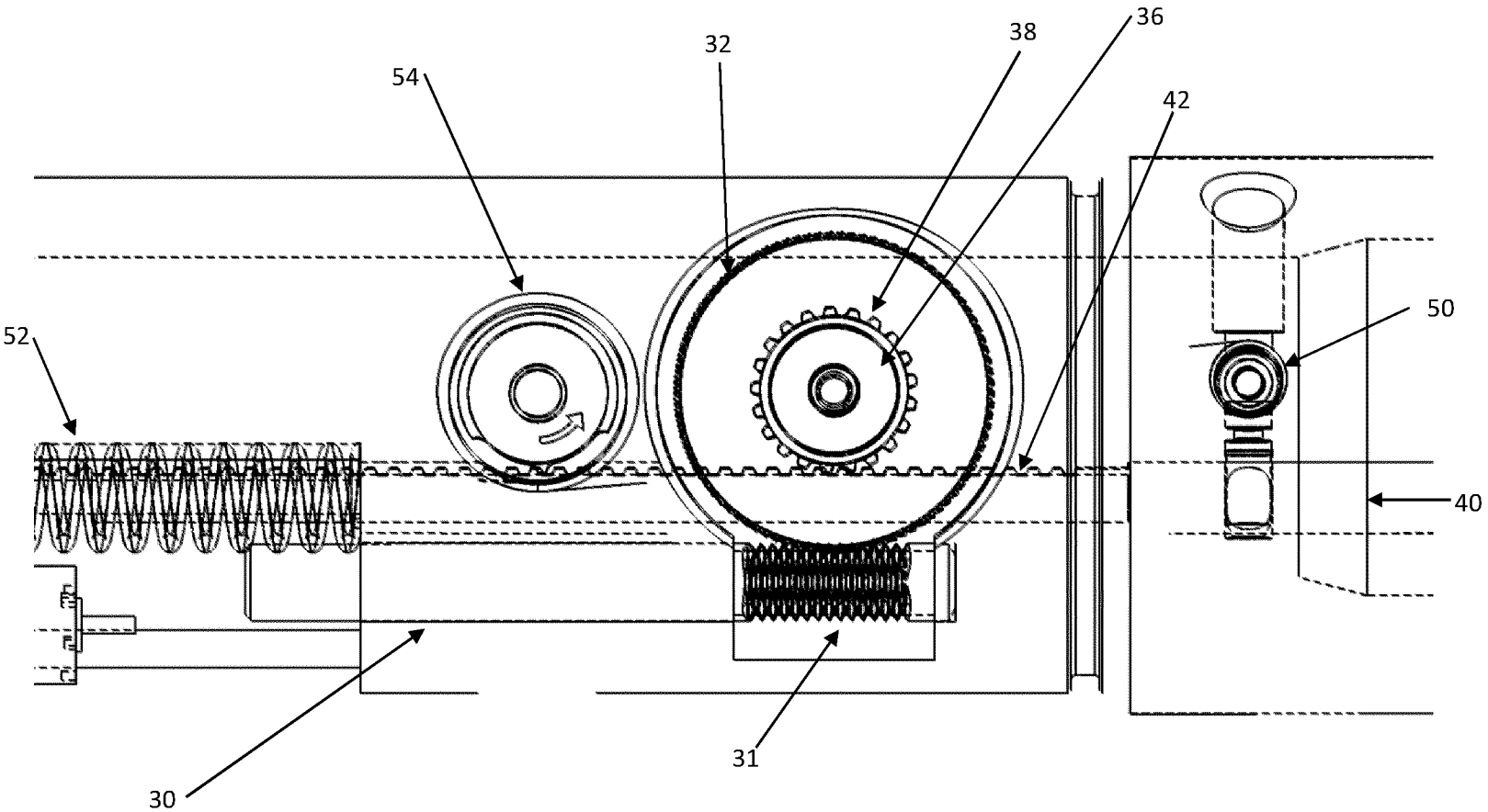
FIG. 5 is a side elevation transparent view of a portion of the subsurface safety valve of FIG. 1.

Turning now to FIGS. 4A, 4B and 5, a portion of the subsurface safety valve 10 is shown. In this embodiment, the subsurface safety valve 10 further comprises a relief valve. The relief valve is configured to equalize pressure within the subsurface safety valve 10. The relief valve is configured to be actuated by linear motion of the elongate member 14 as will be described. In this embodiment, the relief valve comprises a ball valve 50.

In this embodiment, the subsurface safety valve 10 further comprises an elastic member. In this embodiment, the elastic member is a spring 52. The spring 52 is positioned around a portion of the shaft 40 such that linear motion of the shaft 40 results in compression or decompression of the spring 52. When the spring 52 is compressed, the spring 52 maintains stored potential energy. When the spring 52 is released from a compressed state or decompressed, the stored potential energy is released. As will be described, the spring 52 is configured to decompress (or be released from a compressed state) upon loss of a signal to the electrically controlled drive 16 and compress when the electrically controlled drive 16 receives a signal.

In this embodiment, the spring 52 is ratcheted. As previously described, the gear assembly 12 comprises a retention mechanism 24 comprising a ratchet wheel 54. The ratchet wheel 54 comprises a rotary ratchet mechanism that engages the toothed portion 42 of the shaft 40 upon linear motion of the shaft 40. In this embodiment, teeth of the ratchet wheel 54 engage the toothed portion 42 of the shaft 40. As will be described, the ratchet wheel 54 maintains the linear position of the shaft 40 even after linear motion of the shaft 40 has halted and therefore also maintains compression of the spring 52.

While the elastic member has been described as being a spring 52, one of ordinary skill in the art will appreciate that other configurations are possible. In another embodiment, the elastic member is a compressible material. In another embodiment, the elastic member is a gas spring.

In this embodiment, the ratchet wheel 54 is electrically controlled. The ratchet wheel 54 is electrically controlled via the solenoid 56. In this embodiment, the solenoid 56 is an electric solenoid, specifically, an electric latching linear solenoid. In another embodiment, the solenoid 56 is a magnetic solenoid, such as a magnetic latching linear solenoid. One of ordinary skill in the art will appreciate that other types of solenoids, besides electric and magnetic, may be used.

The solenoid 56 is attached to a rotary ratchet release mechanism of the ratchet wheel 54. The solenoid 56 is connected to the ratchet wheel 54 such that if the solenoid fails to receive a signal, the ratchet wheel 54 will release and allow linear motion of the shaft 40. In this embodiment, the signal is electric; however, the signal may be an electric signal, a magnetic signal, an acoustic signal or a power signal (electric or otherwise).

Upon loss of electric signal to the solenoid 56, the spring 52 is no longer latched and returns to an uncompressed state. Further, upon loss of electric signal to the solenoid 56, the spring 52 is not compressed and linear motion of the shaft 40 is allowed.

During operation of the subsurface safety valve 10, the electrically controlled drive 16 receives a signal to rotate the gear assembly 12. Specifically, power to the electric motor is provided. The electric motor rotates the worm screw 30. Rotation of worm screw 30 is transferred to the worm gear 32 via the meshing between the threaded portion 31 of the worm screw 30 and the teeth of the worm gear 32.

As previously stated, the spur gear 38 is connected to the same axis as the worm gear 32. As such, rotation of the worm gear 32 results in rotation of the spur gear 38. The teeth of the spur gear 38 mesh with the toothed portion 42 of the shaft 40 such that rotation of the spur gear 38 causes linear motion of the shaft 40. Teeth on the ratchet wheel 54 engage with the toothed portion 42 of the shaft 40 such that linear motion of the shaft 40 results in rotary motion of the ratchet wheel 54.

As the shaft 40 moves linearly, the spring 52 is compressed to store potential energy. The shaft 40 is ratcheted by the ratcheting wheel 54 to maintain its linear position. The spring 52 is compressed by the ratcheted shaft to maintain its stored potential energy even after the shaft 40 has halted linear motion. The ratcheting wheel 54 maintains the shaft 40 in its linear position by the solenoid 56 so long as the solenoid 56 does not suffer a loss of signal. In other words, as long as the solenoid continues to receive a signal (e.g. an electrical signal or electrical power), the ratcheting wheel 54 maintains the shaft 40 in its linear position.

Figure 6:
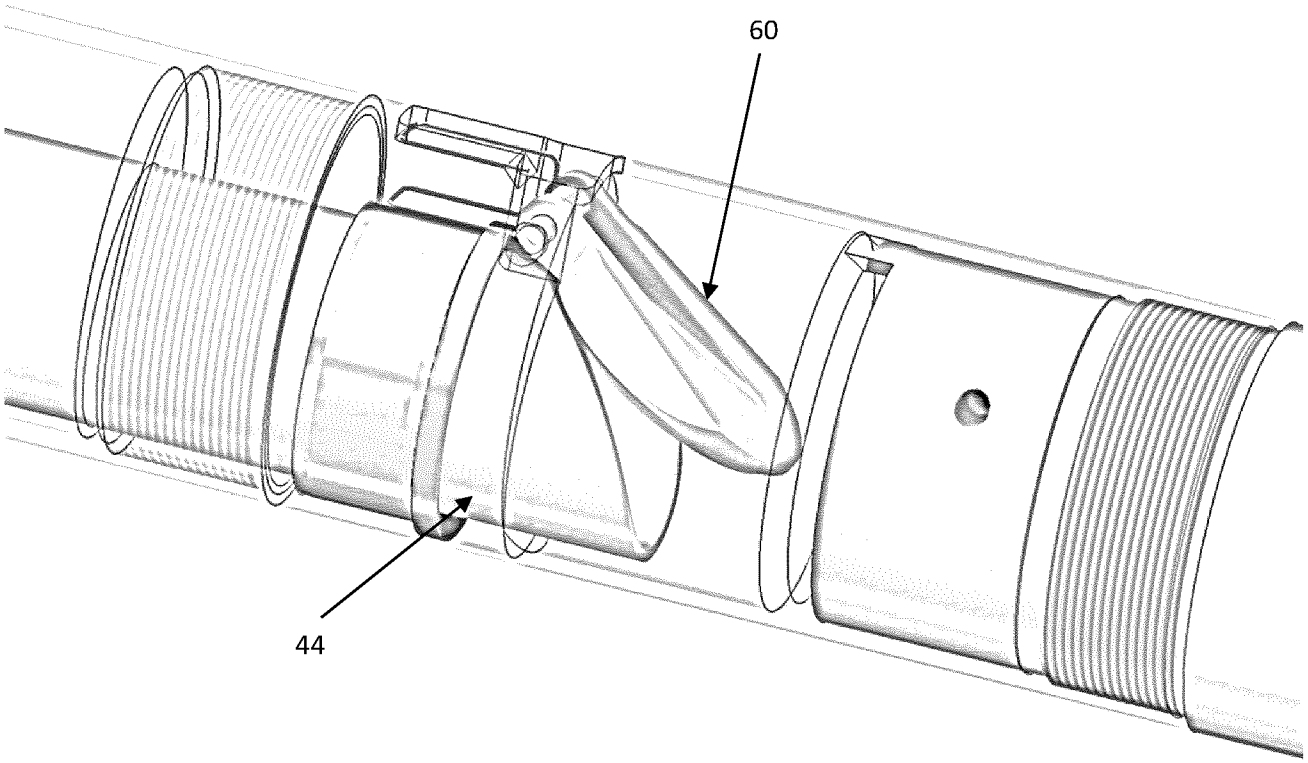
FIG. 6 is a perspective transparent view of a portion of the flow tube of the subsurface safety valve of FIG. 1.

As the shaft 40 moves linearly, the connected flow tube 44 moves linearly to actuate the valve 18. Specifically, the flow tube 44 opens the flow tube 18. As shown in FIG. 6, one end of flow tube 44 contacts the flapper 60 of the valve 18. The end of the flow tube 44 that contacts the flapper 60 is profiled or curved such that the end of the flapper 60 furthest from the hinge axis of the flapper 60 is contracted first. This minimizes the force and torque required to open the valve 18.

During the linear motion of the shaft 40, the ball valve 50 is rotated to the open position thereby providing pressure relief of the subsurface safety valve 10.

When the electrically controlled drive 16 stops rotating the worm screw 30, the worm gear 32 and spur gear 38 stop rotating. Linear motion of the shaft 40 is halted. The shaft 40 is held in position by the ratchet wheel 54. The flow tube 44 thereby maintains the flapper 60 in an open position as shown in FIG. 7.

If the solenoid 56 has a loss of a signal, such as a loss of electrical signal or electrical power, the ratchet wheel 54 releases the shaft 40. The spring 52 decompresses thereby releasing stored potential energy. The shaft 40 returns to its original position. The flow tube 44 actuates the valve 18. The flow tube 44 closes the valve 18 and allows the flapper 60 to return to its resting position. The sprag clutch 36 allows the spur gear 38 to freely rotate as the shaft 40 returns to its resting position ensuring that the spur gear 38 does not inhibit the shaft 40 returning to its resting position. In other words, the sprag clutch 36 housed within the spur gear 38 ensures linear motion of the retracting shaft 40 is not transferred through to the worm gear 32.

The linear motion of the retracting shaft 40 further closes the ball valve 50 to prevent release of potentially hazardous fluids through the ball valve 50.

Figure 7:
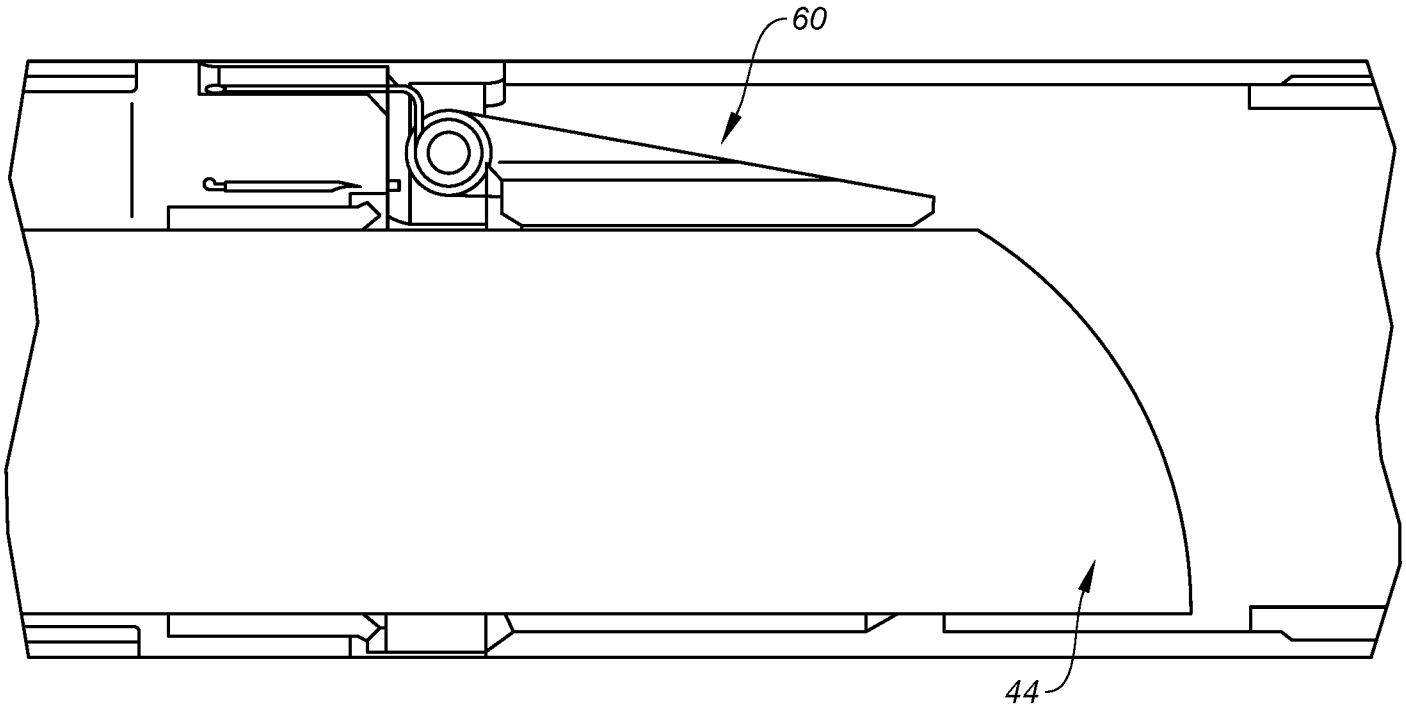
FIG. 7 is a side elevation transparent view of a portion of the flow tube of the subsurface safety valve of FIG. 1.

As shown in FIGS. 6 and 7, a torsion spring of the valve 18 ensures the flapper 60 returns to the respective flapper seat to establish a seal thereby preventing release of potentially hazardous fluids and isolating the wellbore.

The subsurface safety valve 10 described may include one or more sensors. In one embodiment, the subsurface safety valve 10 includes one or more pressure differential sensors. At least one pressure differential sensor is configured to sense the pressure across the valve 18. The pressure sensed across the valve 18 may be used to determine whether pressure equalization has been achieved across the valve 18. The same or another pressure differential sensor is configured to verify closure of the valve 18. Verification of valve 18 closure may be determined based on equalized pressure. The same or another pressure differential sensor may be used to verify that the valve 18 is maintaining a seal. This reduces the likelihood of unwanted pipe fluid release.

The sensors may include one or more position sensors. At least one position sensor is configured to verify the position of one or more elements of the subsurface safety valve 10. In one embodiment, one or more position sensors are configured to sense the position of the shaft 40. In particular, the position sensors are configured to determine whether the shaft 40 is fully extended, such that the flapper 60 is open; fully retracted, such that the flapper 60 is closed; or partially extended/retracted, such that the flapper 60 is partially open/closed. In one embodiment, one or more position sensors are configured to sense the position of the flow tube 44. In particular, the position sensors are configured to determine whether flow tube 44 is fully extended, such that the flapper 60 is open; fully retracted, such that the flapper 60 is closed; or partially extended/retracted, such that the flapper 60 is partially open/closed. The described position sensors may be position indication sensors.

The described operation of the subsurface safety valve 10 may be repeated as the electrically controlled drive 16 may rotate the worm screw 30 as previously described.

The above described subsurface safety valves and methods of operating a subsurface safety valve may provide for cheaper, more efficient and/or more robust alternatives to known valves and methods. Furthermore, the above described subsurface safety valves and methods of operating a subsurface safety valve may result in reduced wear of components and/or a longer lasting valve.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the invention may consist of any such individual feature or combination of features. In view of the foregoing description it will be evident to a person skilled in the art that various modifications may be made within the scope of the invention.

The invention claimed is:

1. A subsurface safety valve, comprising:

an elongate member disposed for linear motion in a first linear direction and in a second linear direction opposite the first linear direction;

an elastic member in communication with the elongate member;

a valve having a flapper;

a gear assembly having a worm drive that includes a worm screw, a worm gear, and a spur gear, wherein the worm screw is in meshed engagement with the worm gear, and the worm gear and the spur gear are in communication with one another, and the spur gear is in communication with the elongate member;

an electrically controlled drive configured to rotationally drive the worm screw;

a retention mechanism engaged with the elongate member, wherein the retention mechanism is configured to retain the elongate mechanism member in a latched position upon receipt of a signal, and configured to release the elongate member in the absence of the signal;

wherein the electrically controlled drive is configured to drive the gear assembly and thereby drive the elongate member in the first linear direction upon receipt of a valve signal, and driving the elongate member in the first linear direction causes the elastic member to compress and causes the elongate member to engage with the flapper of the valve to open the valve;

and wherein upon release of the elongate member, the elastic member biases the elongate member in the second linear direction.

2. The subsurface safety valve of claim 1, wherein the worm screw is rotatable about a first axis, and the worm gear and the spur gear are rotatable about a second axis, and the first axis and the second axis are perpendicular to one another.

3. The subsurface safety valve of claim 1, wherein the elastic member is configured to be ratcheted, and wherein the ratcheted elastic member is configured to maintain a compressed state after linear motion of the elongate member stops.

4. The subsurface safety valve of claim 1, wherein the retention mechanism comprises a ratchet configured to maintain the elastic member in a compressed state after linear motion of the elongate member stops.

5. The subsurface safety valve of claim 4, wherein the ratchet is controlled via a solenoid that is configured to receive the signal, and wherein upon loss of the signal to the solenoid, the elastic member is no longer maintained in the compressed state.

6. The subsurface safety valve of claim 1, wherein the elastic member is a spring.

7. The subsurface safety valve of claim 1, wherein the spur gear is part of a one-way clutch that is configured to allow drive and torque in a first rotary direction and configured to freewheel in a second rotary direction, wherein the first rotary direction is opposite the second rotary direction.

8. The subsurface safety valve of claim 1, wherein the elongate member includes a flow tube.

9. The subsurface safety valve of claim 8, wherein an end of the flow tube is configured to contact the flapper at a point furthest from a hinge axis of the flapper.

10. The subsurface safety valve of claim 1, wherein the electrically controlled drive is an electric motor.

11. The subsurface safety valve of claim 1, wherein the spur gear and the elongate member are disposed in a rack and pinion configuration.

12. A subsurface safety valve, comprising:

an assembly configured to convert rotary motion from an electrically controlled drive into linear motion of a member, the member configured to actuate a valve;

the assembly comprising a gear assembly that includes a one-way clutch configured to allow drive and torque in one rotary direction and configured to freewheel in the other opposition rotary direction;

wherein the one-way clutch comprises a sprag clutch and the sprag clutch is within a spur gear.

13. The subsurface safety valve of claim 12, wherein linear motion of the member actuates a relief valve, and wherein the relief valve comprises a ball valve.

* * * * *